United States Patent [19]

Sauder

[11] Patent Number: 4,984,405

[45] Date of Patent: Jan. 15, 1991

[54] INSULATION AND THE PROVISION THEREOF

[75] Inventor: Robert A. Sauder, Emporia, Kans.

[73] Assignee: Thermal Ceramics, Inc., Augusta, Ga.

[21] Appl. No.: 920,282

[22] Filed: Oct. 17, 1986

Related U.S. Application Data

[63] Continuation of Ser. No. 830,462, Feb. 18, 1986, abandoned, which is a continuation of Ser. No. 752,078, Jul. 3, 1985, abandoned, which is a continuation of Ser. No. 331,673, Dec. 17, 1981, abandoned.

[51] Int. Cl.[5] ..... E04B 1/80

[52] U.S. Cl. ..... 52/506; 52/404; 52/509; 40/336

[58] Field of Search ..... 52/506, 509, 404, 511; 110/331, 336, 338

[56] References Cited

U.S. PATENT DOCUMENTS

| | | | |
|---|---|---|---|
| 3,832,815 | 9/1974 | Balaz et al. | 52/506 |
| 3,993,237 | 11/1976 | Sauder et al. | 52/747 |
| 4,381,634 | 5/1983 | Hounsel et al. | 52/506 |

*Primary Examiner*—Richard E. Chilcot, Jr.
*Attorney, Agent, or Firm*—Arnold, White & Durkee

[57] ABSTRACT

An insulation member for use in insulating a high temperature furnace, the insulation member comprising a deformable mat of fibrous insulation material, and attachment means located in the mat for attaching the mat to a furnace surface to be insulated, the attachment means being resiliently deformable for resiliently biasing the mat into conforming engagement with such a surface.

43 Claims, 5 Drawing Sheets

18
10.1
12
20
20
22
26
32
28.1
40
16
46
14.1
42
34
44
30.1
24.1

62
14.1
60
32
26
48
56
52
40
36
38
58
54
34

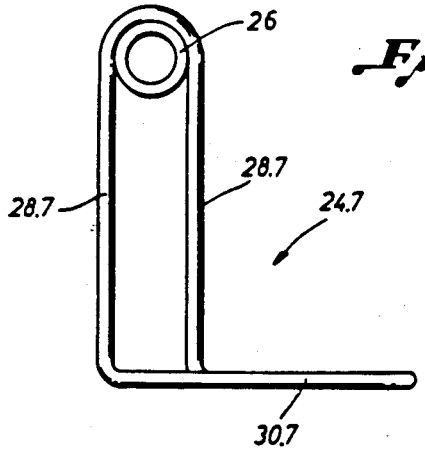
Fig. 10
Fig. 11
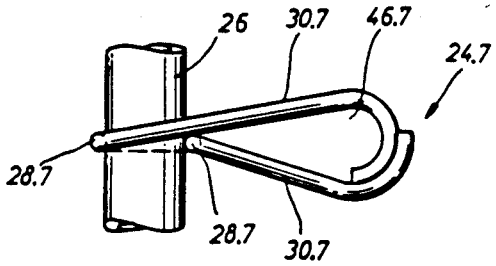
Fig. 12
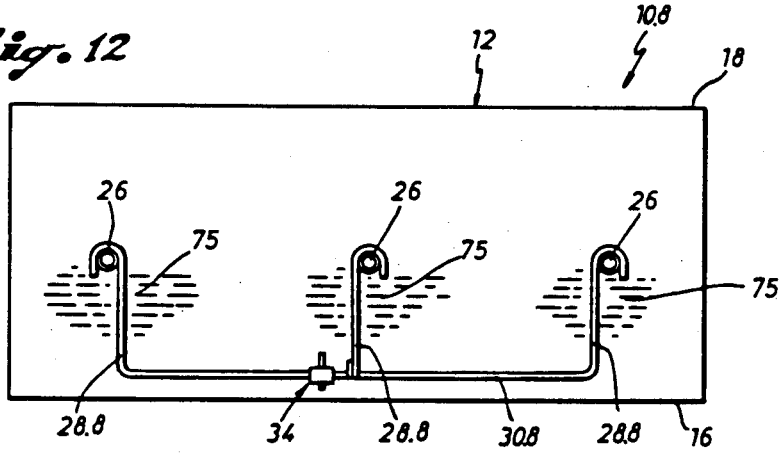
Fig. 7
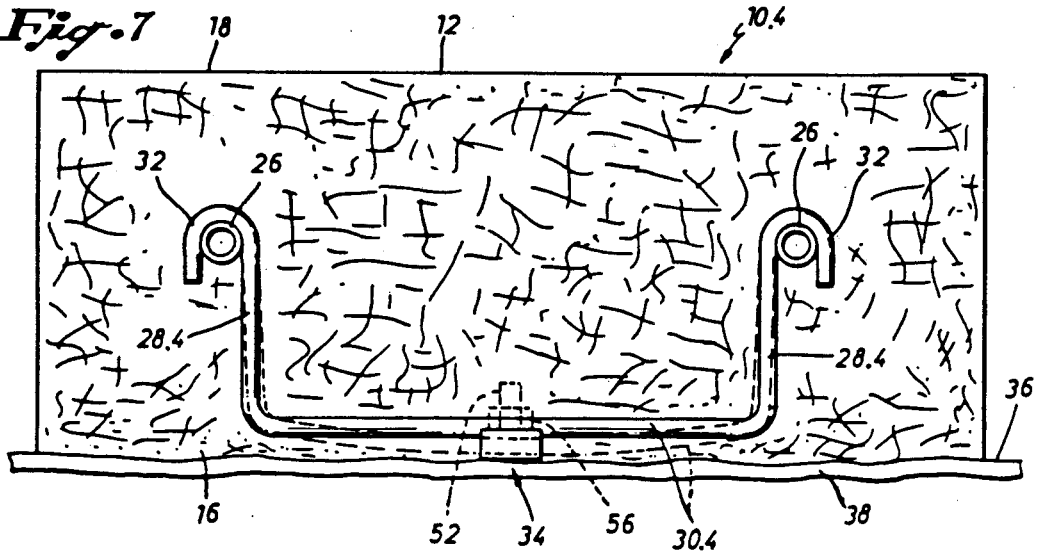

INSULATION AND THE PROVISION THEREOF

This is a continuation of application Ser. No. 830,462, filed Feb. 18, 1986, now abandoned, which was a continuation of application Ser. No. 752,078, filed July 3, 1985, now abandoned, which was a continuation of application Ser. No. 331,673, filed Dec. 17, 1981, now abandoned.

This invention relates to insulation and the provision thereof. More particularly, this invention relates to an insulation member for use in insulating a surface, a method of providing insulation for a surface, and attachment means for attaching insulation to a surface. Still more specifically, this invention has particular application in regard to a high temperature insulation member for use in insulating a furnace surface, and to the provision of high temperature insulation in a furnace for insulating a furnace wall surface.

The problems involved in insulating the interior surfaces of the walls (comprising the walls, ceiling, interior door surfaces, and other furnace surfaces to be insulated) of a furnace are well-known. Historically, the interiors of high temperature furnaces have been lined with various types of bricks capable of withstanding high temperatures. When brick linings wear out, however, it is an odious and time consuming task to replace the old brick with new brick lining.

The disadvantages of brick linings, coupled with the need for more effective and higher temperature linings, has led to the use of insulating fiber materials such as ceramic fiber materials for providing insulation or for providing at least the hot face of the insulation.

Ceramic fiber material, as referred to herein, is generally available in the form of a ceramic fiber blanket which is customarily manufactured in processes similar to the conventional paper making processes. As such, the fibers which constitute the blanket are oriented in planes which are generally parallel to the longitudinal direction of formation of the blanket or sheet.

If sections of such a blanket or sheet are cut to form mats or batts, and are applied as such to an interior surface of a furnace, the mat or batt would be in the form of a blanket. in which the ceramic fibers will be lying in planes generally parallel to the surface to which the mat or batt is attached.

In such blanket form application to a furnace surface, the majority of the fibers of the ceramic material will tend to be lying in a direction which would tend to be colinear with the direction of formation of the blanket itself, although a considerable number of fibers will still be in a more or less randomly disposed orientation. Where the fibers are disposed in planes which are parallel to the furnace wall, there is generally a tendency for the fiber blanket material to produce cracks which result from heat shrinkage.

In addition, when using ceramic fiber insulation in blanket form, high temperature environments lead to problems relating to cracking, delamination and devitrification.

Attempts have been made to overcome the problems presented by the use of ceramic fiber in blanket form by severing strips of fiber from such a formed sheet in a direction transversely to the direction of formation of the sheet.

These strips are cut from the fiber sheet in widths that represent the linear distance required from the cold face to the hot face of the insulating fiber mat. The cut strips are then placed on edge and laid lengthwise in side-by-side relationship with a sufficient number of strips being employed to provide a mat of a desired width.

Naturally, the thickness of the fiber sheet from which these strips are cut will determine the number of strips required to construct a mat of a required width.

By applying such strips to a furnace interior surface where the fibers of the ceramic fiber material generally extend transversely to the interior surface of the furnace wall, and where the fiber planes extend transversely to such interior surface, the problems presented by cracking, delamination and devitrification are substantially reduced.

In addition, since ceramic fiber material tends to be resiliently compressible (or at least compressible with a limited degree of resilience), the strips can be arranged in abutting relationship thereby avoiding gaps forming between adjacent strips as a result of shrinkage during use.

Whether insulation material is used in blanket or strip form, some suitable means is required to allow the insulation material to be affixed to an interior surface of a furnace wall. Various methods have been attempted to achieve this objective. Thus, for example, where insulation material is used in blanket form, pins or studs can be prewelded to a furnace wall and the insulation material can then be impaled onto the pins or studs and secured in position by means of nuts or the like.

This procedure is disadvantageous since the pins or studs must be premounted on the furnace walls in a specific layout. This presents the disadvantage that the positioning of the pins or studs cannot readily be altered when required. In addition, because the pins or studs will extend through the insulation material, they will be exposed to the temperature within the furnace and will conduct heat from the furnace directly to the furnace walls. This is not only wasteful but leads to the formation of undesirable hot spots in the furnace walls.

Where insulation material is used in strip form, the strips may be secured to a furnace wall by means of prewelded brackets which are welded to the furnace wall, with the strips being secured to the brackets by means of wires or the like which extend through the fiber strips. This again provides the disadvantage that the brackets must be prewelded in a particular layout making repositioning impossible or impractical. This provides the further disadvantage that the handling of the strips is tedious and laborious.

To overcome these disadvantages attempts have been made to secure insulation material to a furnace wall by mounting the insulation material on rigid ceramic material blocks or on supporting sheets or panels to form modules. The modules can then be separately handled and can be mounted on a furnace wall by mounting the rigid blocks, the sheets, or the panels to the furnace wall.

While this modular approach provides a number of advantages, it still presents the problem of effectively mounting the insulation material onto the rigid blocks, the sheets or the panels, as the case may be. Where the backing sheet is in the form of a rigid block, the fibers can be attached to the backing sheet by threading wires or rods through the insulating material and then attaching the wires or rods to the backing sheet by means of tying wires or the like at spaced intervals. This solution is, however, cumbersome and expensive. In addition, it is not particularly effective where the backing sheets are in the form of less rigid sheet material.

The most promising solution which has heretofore been suggested, has been to mount the insulation material onto a backing sheet by utilizing a temperature resistant adhesive. This solution has been relatively successful for many applications. However, in furnaces which operate in a sulfur environment or in which sulfur burning fuels are employed, corrosive liquids (which usually include sulfuric and/or sulfurous acids) form on the inner walls of the furnace. As far as applicant is aware, available adhesives and ceramic cements are not capable of withstanding the action of such corrosive liquids over an extended period. The adhesive or cement therefore tends to fail after a period of use, resulting in premature failure of the modules and separation of the insulation material from the backing sheets and thus from the furnace walls.

In addition, in the presence of iron, the sulfuric and sulfurous acids react with iron to form iron sulfates. Applicant has found that these iron sulfates have an extremely corrosive effect on ceramic fiber.

Ironically, in attaching ceramic fiber insulation mats to a furnace wall by means of a temperature resistant adhesive or cement, the mat temperature gradient will normally not permit sulfuric or sulfurous acids to form except in the vicinity of the cold face of the mat. That is, only in the vicinity of the cold face of the mat, will the temperature be low enough for the sulfuric and/or sulfurous acids to form. Therefore, in the very zone where the insulation system is most vulnerable, the corrosive acids can form (and do form when sulfur containing fuels are employed). Again, in the most vulnerable area, the furnace casing or a backing sheet of the insulation material, provides metal which is corroded by the acids in the interface zone of the insulation material and the furnace casing to produce ferric sulfates which corrode the ceramic fiber.

The life of such insulation is therefore limited since the adhesive or cement eventually becomes destroyed and/or the ceramic fibers which are in intimate contact with the adhesive or cement and serve to attach the remainder of the insulation mat to the backing sheet or furnace casing, as the case may be, will be subject to corrosive activity. The fibers will therefore tend to fail in the proximity of the adhesive or cement layer after a period of use. These twin failures in the critical zone will thus ultimately lead to failure of the insulation system.

It is accordingly an object of this invention to provide a method of attaching insulation to a surface, and an insulation member for attachment to a surface to reduce or overcome the disadvantage of the prior known methods.

Applicant has postulated that because of the heating effect in a furnace, heated air will tend to rise and create an excess pressure in the upper region of the furnace. This over pressure will result in air flow in an outward direction through insulation material lining the walls of the furnace.

Since most furnace insulation systems leave significant air gaps between the insulation material and the casing surface, air flow through the insulation material in the upper regions of a furnace will result in such air being cooled and flowing downwardly along the interface between the insulation material and the furnace walls or casing surface.

Applicants believe that this airflow will be encouraged by air gaps between insulation material and furnace casings. Applicant further believes that this airflow will result in undesirable heat loss. Applicant further believes that this airflow will tend to encourage corrosion in the interface zone.

Even if prior art insulation materials are firmly attached to a furnace wall or casing, during temperature variations in the wall or casing the casings tend to deflect. Casing regions may therefore change from a concave to a convex configuration and so on. Therefore even if prior art insulation materials or modules are attached firmly to casing surfaces, gaps will be created during deflection of the casings.

Applicant believes, therefore, that it would be advantageous to have insulation material which is firmly engaged with the furnace wall surfaces or casing surfaces and which will remain substantially in contact with such surfaces despite casing deflections as a result of temperature variations.

It is accordingly an object of this invention to provide a method of firmly attaching insulation material to a furnace wall or casing surface.

While the principles of this invention may be employed in attaching insulation material to backing sheets for general insulation as well as for furnace insulation, this invention has particular application for the internal insulation of furnace walls of high temperature furnaces. For the purposes of the present invention "high temperature" will mean temperatures in excess of about 1,600° F. and preferably in the range of about 1,600° F. to about 2,800° F. or more.

Furthermore, in the specification, reference to furnace walls shall mean all furnace surfaces which require insulation including ceilings, doors, and the like.

Ceramic fiber insulation materials are commercially available from several manufacturers and are well-known to those of ordinary skill in this art. Thus, for example, ceramic fiber blankets are manufactured under the trademarks or trade names "Kaowool" (Babcock and Wilcox), "Fiber-Frax" (Carborundum Co.), "Lo-Con" (Carborundum Co.), "Cero-Felt" (Johns-Manville Corp.) and "SAFFIL" (I.C.I.). While most of these ceramic fiber blankets have an indicated maximum operating temperature of about 2,300° F., the end or edge fiber exposure provided by reorientation of fiber strips can provide for effective operation up to about 2,800° F. when the appropriate grade of fiber is used. An appropriate grade would, for example, be SAFFIL alumina fibers.

According to one aspect of the invention there is provided an insulation member for use in insulating a furnace surface, the insulation member comprising a deformable mat of insulation material, and attachment means for attaching the mat to a furnace surface to be insulated, the attachment means being displaceable for resiliently biasing or urging the mat into engagement with such a surface.

The insulation member of this invention may be in the form of a sheet or strip. Preferably, however, the insulation member of this invention is in the form of an insulation module or block for use in side-by-side relationship with corresponding modules or blocks to form an insulating lining.

The insulation member may therefore conveniently be in the form of a module of rectangular or square configuration. The thickness of the module will depend upon the insulation characteristics of the insulation material and upon the furnace environments for which the insulation member is designed.

The insulation material of the mat may be any suitable insulation material which will provide a required degree of heat insulation and which is at least partly deformable, preferably with at least a limited degree of resiliency, to allow the mat to be resiliently biased into engagement with a furnace surface.

The insulation material may therefore, for example, comprise a fibrous insulation material such as a mineral fiber material, a refractory fiber material or a ceramic fiber material. It will be appreciated, however, that any other appropriate insulation material may be employed provided the material is at least partially deformable, and preferably at least partially resiliently deformable, to permit the material of the mat to be resiliently biased into engagement with a surface to be insulated.

Where the insulation material is a fibrous insulation material, the material may for specific applications of the invention be used in blanket form where the fibers are arranged in fiber planes with the planes running generally parallel to the surface to be insulated when the insulation member is attached to such a surface.

This blanket type arrangement does, however, present various disadvantages. In the presently preferred embodiments of the invention, therefore, for the insulation of high temperature furnaces to be operated at temperatures in excess of about 1,600° F., the fibrous insulation material is preferably a material in which the fibers are randomly oriented in fiber planes, with the fiber planes being arranged to extend transversely to a cold face of the member, which cold face would be directed towards a furnace surface to be insulated during use.

The attachment means may be displaceable by the attachment means or substantially the whole of the attachment means being formed out of a suitable resiliently deformable or displaceable material.

In this embodiment of the invention difficulties can be experienced at higher operating temperatures unless the attachment means is formed out of a resiliently deformable material which is capable of withstanding such higher temperatures without losing its resiliency and/or unless the attachment means is positioned in the mat such that it is protected from temperature conditions where it would tend to lose its resiliency.

In a preferred embodiment of the invention, therefore, the attachment means may be resiliently deformable by having a resiliently deformable portion which is positioned proximate the cold face of the mat or member during use. In this way the thickness of the mat can serve to protect the resiliently deformable portion from being overheated during use, thereby insuring that the resiliently deformable portion will retain its resilient characteristics during use to maintain a biasing action during use.

The attachment means may, for example, comprise anchor means associated with the mat, and yoke means extending from the anchor means for attachment to a surface to be insulated. In this embodiment of the invention the yoke means preferably comprises or includes the resiliently deformable portion of the attachment means.

The anchor means may be any appropriate means which is capable of being associated with the insulating mat of the member of this invention, and which may then be attached to a surface to be insulated to thereby attach the insulation member to such a surface.

The anchor means may, for example, comprise one or more elongated rods, bars or tubes which are located in the mat. In an alternative example of the invention, the anchor means may be in the form of a closed figure or in the form of a grid which is located within the mat. In yet a further example of the invention, the anchor means may be in the form of an elongated, non-linear, member which is located within the mat.

While the anchor means may itself be resiliently deformable or deflectable, the anchor means may preferably be of a rigid material so that tension applied to the anchor means would tend to be distributed throughout the anchor means for thereby applying a biasing effect to the material of the mat.

In a preferred embodiment of the invention, therefore, the anchor means may comprise a plurality of anchor tubes which are arranged in laterally spaced relationship to extend through the mat in a plane generally parallel to the plane of the cold face, to thereby distribute any tension applied to the anchor means through the mat.

Where the mat has fiber planes which extend transversely or usually normally to the cold face, the anchor tubes are preferably positioned to extend generally parallel to the cold face but transversely to the fiber planes to thereby provide for effective location of the anchor tubes within the mat.

In an embodiment of the invention a reinforcing material may be located within the mat to reinforce the mat in the vicinity of the anchor means to better distribute the biasing force applied to the anchor means during use.

The reinforcing material may comprise a mesh structure, a deposit of adhesive material, or the like.

The yoke means may be of any appropriate configuration for engagement with the anchor means and for attachment to a surface.

In one embodiment of the invention the yoke means may comprise a connection limb which is connected to or engaged with the anchor means to extend towards the cold face, and a resiliently deformable or displaceable fastening portion for attachment to a surface to be insulated to be resiliently displaced and to thus resiliently bias or urge the connection limb, and thus the anchor means and the mat of the insulation member towards such surface.

In one embodiment the resiliently deformable fastening portion may be in the form of a spring member or the like to provide the urging or biasing action. It may therefore, for example, be in the form of a helical spring, a leaf spring or the like.

In a preferred embodiment of the invention, the resiliently deformable fastening portion may be in the form of a fastening limb which extends transversely to the connection limb.

In a presently preferred embodiment of the invention, the yoke means comprises a pair of connection limbs which are connected together by means of a fastening limb to provide a channel section configuration for the yoke means, with each connection limb having a free end which is engaged with or connected to the anchor means.

The attachment means is preferably located within the mat such that the resiliently deformable portion thereof is recessed inwardly of the cold face of the mat. The resiliently deflectable portion may therefore be resiliently displaced out of the mat towards a surface to be insulated for attachment thereto and for thus resiliently biasing the attachment means and thus the mat towards such surface during use.

The attachment means include a fastener device for use in fastening the attachment means to a surface to be insulated.

In one embodiment of the invention the fastener device may define a bore for receiving a bolt, screw, weld stud or the like to fasten the fastener device to such a surface.

The fastener device may be an integral part of, or a continuous extension, of the material of the yoke means. Alternatively, for example, the fastener device may be in the form of a separate fastener device which is fixed to the yoke means of the attachment means.

The fastener device may include a weld stud which is located thereon to extend into the mat, with the weld stud having a fusible portion extending through the bore of the fastener device. In this embodiment the fastener device may include an arc shield which is positioned to surround the fusible portion of the weld stud to permit attachment thereof to a surface to be insulated by internal welding.

The attachment means may further include bias means for biasing the fastener device towards a surface to be insulated once the fastener device has been fastened to that surface. The bias means may, for example, be provided by a nut which may be threaded onto a stud, bolt or the like to draw the fastener device and thus the resiliently deformable fastening portion towards the surface to be insulated and thereby provide the resilient biasing effect.

The invention further extends to a method of providing insulation in a furnace which comprises attaching a mat of insulation material to a furnace wall surface, and biasing the mat into engagement with the surface.

The method may preferably comprise resiliently biasing the mat into conforming engagement with the surface.

In a preferred embodiment of the invention, the method comprises maintaining the bias action during use to urge the mat to remain biased into conforming engagement with the surface during use despite deflection of the surface as a result of temperature variation.

The method may comprise attaching resiliently deformable attachment means which is associated with the mat, to the furnace wall to thereby attach the mat to the furnace wall surface, and then biasing the attachment means resiliently towards the surface to maintain a bias engagement between the mat and the surface.

The invention further extends to attachment means for attaching a mat of insulation material to a furnace surface, the attachment means comprising anchor means for location in such a mat, and yoke means to be extended from the anchor means towards such a surface for attachment thereto, the attachment means being resiliently deformable for biasing such a mat towards such a surface.

The invention further extends to an insulation module for insulating a surface, the insulation module comprising a deformable mat of insulation material having a cold face to be positioned against a surface to be insulated, and attachment means for attachment to such a surface to attach the module thereto, the attachment means comprising anchor means located within the mat, and connection means for attachment to a surface to be insulated, the connection means extending from the anchor means towards the cold face but being spaced inwardly of the cold face, and the connection means being displaceable relatively to the cold face to compress the material of the mat between the anchor means and the cold face and to urge the cold face into engagement with such a surface.

By having the connection means extending towards the cold face but being spaced inwardly of the cold face, the connection means may be displaced towards a surface to be insulated to thereby compress the material of the mat between the anchor means and the cold face and to thereby urge or bias the cold face into engagement with such a surface.

If the attachment means is rigid, then the bias action will be provided by compression or resilient compression of the material of the mat. On the other hand, if the attachment means includes a resiliently deformable or displaceable portion, which is preferably provided by the connection means, then the bias or urging action can be provided by the resilient displacement of the connection means, or by both the resilient displacement of the connection means and the compression, or resilient compression, of the material of the mat.

The attachment means may preferably include a fastener member to be attached to a surface to be insulated to attach the connection means to such a surface, and may include bias means to urge the connection means towards such a surface when the fastener member is attached thereto.

The bias means may be any actuable or operable bias means which is connected to or associated with the connection means or the fastener member, and which can be actuated or operated to provide the bias effect.

The invention further extends to an insulation module for use in insulating a furnace surface, the insulation module comprising a mat of deformable insulation material, and attachment means for attaching the mat to a furnace surface to be insulated, the attachment means being resiliently deformable for resiliently biasing the mat into engagement with such a surface.

The attachment means is preferably resiliently deformable by having a resiliently displaceable portion which is positioned proximate a cold face of the module which is to be directed towards a furnace surface to be insulated.

The resiliently displaceable portion of the attachment means is preferably positioned to extend generally along the plane of or generally parallel to the cold face but recessed inwardly from the cold face to permit resilient displacement towards the cold face for providing a bias or urging action during use.

While this invention is particularly appropriate and effective for use in providing high temperature insulation for furnaces, it will be appreciated that the invention can equally have application in securing other forms of insulation to surfaces where firm engagement between the insulation material and the surface to be insulated is required or preferred. Such alternative applications of the invention are therefore also within the scope of this invention. However, in the preferred applications of the invention, the invention would be employed in high temperature furnaces since these applications are the ones in which the prior art systems have the major drawbacks and in which this invention can therefore provide major advantages.

Embodiments of the invention are now described by way of example with reference to the accompanying drawings.

In the drawings:

FIG. 7 shows, to an enlarged scale, a diagrammatic side elevation of the module of FIG. 4 attached to a furnace casing surface;

FIGS. 10 and 11 show a diagrammatic side view and underside plan view respectively of an alternative form of yoke means; and FIG. 12 shows a diagrammatic, end elevation of yet a further alternative embodiment of a module in accordance with this invention.

Figure 1:
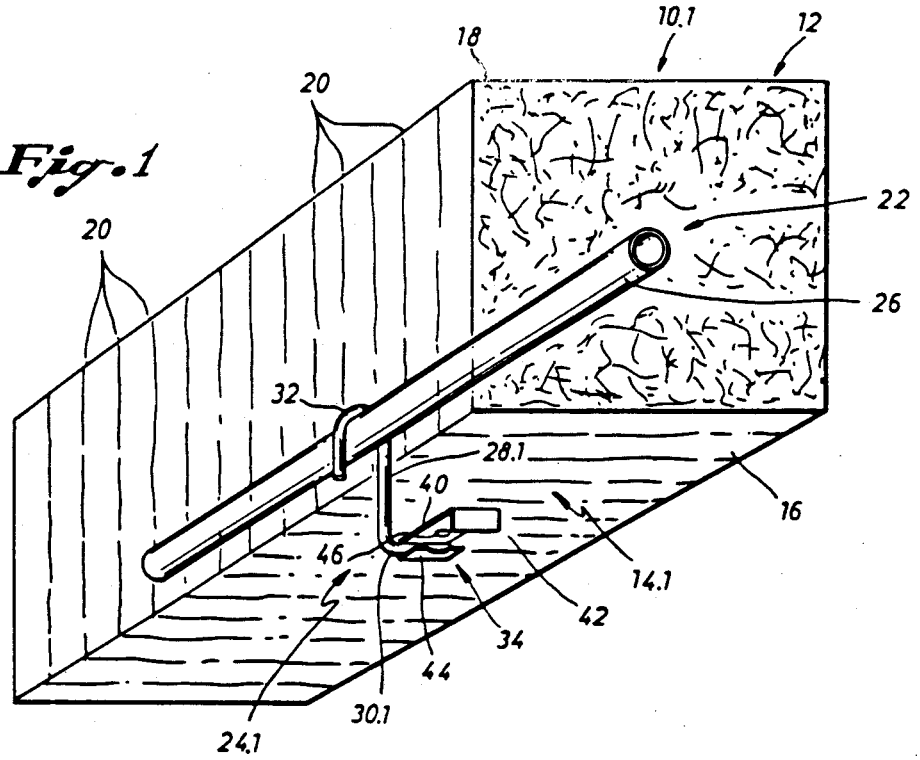
FIG. 1 shows a diagrammatic oblique view of one embodiment of an insulation module in accordance with this invention.
Figure 2:
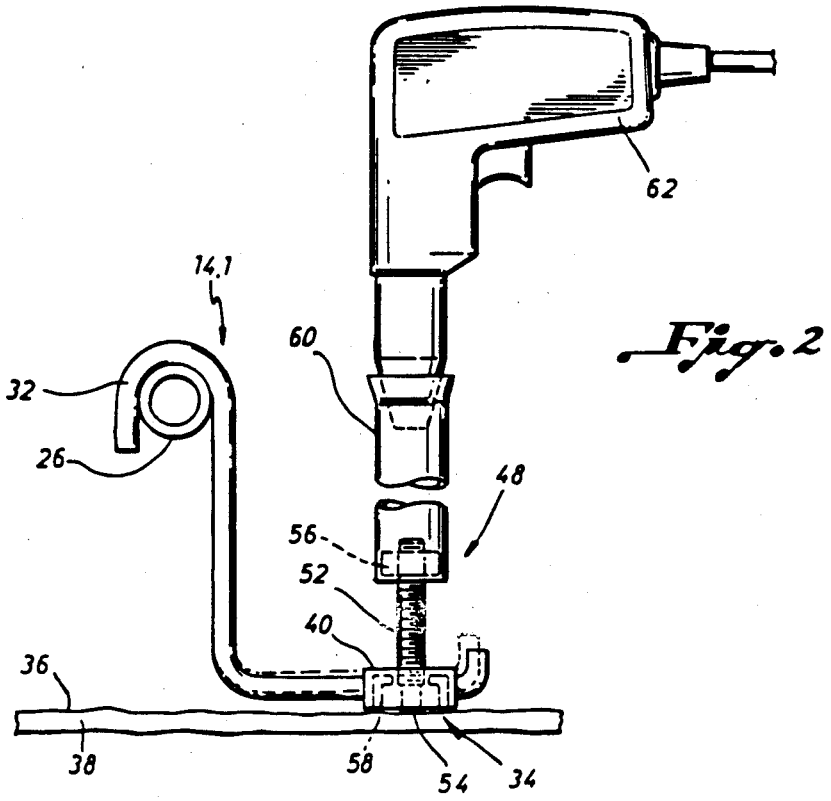
FIG. 2 shows, to an enlarged scale, a fragmentary, diagrammatic, side elevation of the attachment means of the module of FIG. 1 in the process of being secured to a furnace or casing wall surface by means of an internal stud welding system.

With reference to FIGS. 1 and 2 of the drawings, reference numeral 10.1 refers generally to a high temperature insulation module for the insulation of high temperature furnaces, the module 10.1 comprising a deformable mat 12 of insulation material, and attachment means 14.1 for attaching the mat 12 to a furnace surface to be insulated, the attachment means 14.1 being resiliently deformable for resiliently biasing the mat 12 into conforming engagement with such a furnace surface.

The mat 12 has a cold face 16 which is to be directed towards a furnace or casing wall surface to be insulated during use, and has an opposed hot face 18 which would be directed towards the interior of a furnace during use.

The deformable mat 12 is preferably formed out of a ceramic fiber material in which the fibers of the material are randomly oriented in fiber plans 20, with the fiber planes being arranged in side-by-side relationship to extend from the cold face 16 to the hot face 18 at right angles to these faces.

With this particular arrangement of the fiber planes in which the ceramic material strips are arranged in end or edge exposure of the fiber planes 20, the deformable mat 12 will be resistant to delamination and should be more resistant to devitrification and cracking.

In addition, the natural resiliency of the ceramic fiber will result in effective cover and thus concealment of the attachment means in the mat. The attachment means will thus be protected by the fiber against the furnace heat.

The attachment means 14.1 comprises anchor means 22 and yoke means 24.1.

The anchor means 22 comprises an elongated, rigid anchor tube 26 which is located in the mat 12.

The anchor tube 26 is preferably a rigid tube of ceramic material which extends from one side to the opposed side of the mat 12 and is spaced from both the cold face 16 and the hot face 18.

In the embodiment of the invention illustrated in the drawing, the anchor tube 26 is spaced about 2 inches from the cold face 16.

The anchor tube 26 is spaced sufficiently from the hot face 18 to insure that it is protected from the furnace heat, and to thereby insure that the yoke means 24.1 will likewise be protected from overheating during use.

The yoke means 24.1 comprises a connection limb 28.1 and a resiliently deformable fastening portion in the form of a fastening limb 30.1.

The connection limb 28.1 has a hook formation 32 at its free end. The hook formation 32 is engaged with the anchor tube 26 to thereby connect the yoke means 24.1 to the anchor means 22.

The fastening limb 30.1 extends from the opposed end of the connection limb 28.1 transversely thereto to provide a generally L-shaped configuration.

The yoke means 24.1 is made of a suitable material so that it will be resistant to corrosion and will at the same time be resiliently deflectable to provide the resilient deformability of the attachment means 14.1.

The yoke means 24.1 is therefore, for example, preferably made out of a stainless steel so that it will be resistant to corrosion and will be resiliently deformable.

In a preferred embodiment of the invention the yoke means 24.1 is made out of a high yield material such as A304 stainless steel. This is one of the 18-8 stainless steel type A304 high yield materials which will be resistant to corrosion and which, with proper design and location, will remain resiliently deflectable during use in the required zone.

The yoke may, for example, be made out of 3/16 inch diameter rod. The anchor tubes may, for example, be made out of 12 inch long ceramic tube having a ½ inch outside diameter and a ¼ inch inner diameter.

The thickness of the mat 12 between the hot and cold faces 18 and 16 will of course be appropriate for the furnace environment in which the module 10.1 is to be used. Typically, therefore, the thickness may be at least about 3 inches, and may vary between about 3 inches and 6 inches or more.

To provide for adequate heat protection for the anchor tube 26, and yet insure that it has sufficient ceramic fiber material between it and the cold face 16 for effective resilient compression of the material of the mat 12, the tube is conveniently positioned where it is spaced about 2 inches from the cold face 16. It will be appreciated, however, that the spacing may vary depending upon the furnace environment for which the module 10.1 is designed, the type of material from which the mat 12 is formed, the conductivity and properties of the material of the yoke means 24.1 and the extent to which compression of the material of the mat is required.

The yoke means 24.1 is engaged with the anchor tube 26 and extends therefrom in the direction of the cold face 16. The fastening limb 30.1 extends transversely to the connection limb 28.1 and lies generally in the plane of the cold face 16.

The fastening limb 30.1 is, however, recessed inwardly of the cold face 16 to permit resilient deflection of the yoke means 24.1 to provide a resilient biasing action during use.

The extent to which the fastening limb 30.1 would be recessed into the mat 12 behind the cold face 16 will depend upon the considerations discussed above, as also the resiliency of the yoke means 24.1 and the configuration thereof. In the embodiment illustrated in FIG. 1 of the drawings, the fastening limb 30.1 may be recessed say between about ½ inch and 1 inch from the cold face 16.

The attachment means 14.1 further includes a fastener device 34 for use in fastening the limb 30.1 to the surface 36 of a furnace wall or casing 38 as shown in FIG. 2.

The fastener device 34 is in the form of a fastener bracket having a base wall 40, a flange 42 at one end of the base wall 40, and a gripping flange 44 at the opposed end of the base wall 44 in engagement with the fastening limb 30.1. The gripping flange 44 may be in gripping engagement with the limb 30.1 may be crimped thereto, may be welded thereto, or may otherwise be connected thereto.

The base wall 40 is provided with a bore 46 for accommodating a weld stud to secure the fastener device 34 to the surface 36.

As can be seen particularly in FIG. 2 of the drawings, the module 10.1 includes a fastener member 48 which is associated with the fastener device 34 for fastening it to the surface 36.

The fastener member 48 comprises a weld stud 50 having a threaded shank 52 which extends through the bore 46, and having a stud tip 54 of relatively smaller cross-section at its end.

Bias means in the form of a nut 56 is located on the threaded shank 52.

The fastener device 34 further includes an arc shield 58 of ceramic material which is positioned in the fastener device 34. The arc shield 58 is held in position by means of an annular retainer washer (not shown) which has radially inwardly extending fingers to engage with a groove (not shown) in the stud tip 54.

In use, for attaching the module 10.1 to the surface 36, the module 10.1 will be provided with the attachment means 14.1 located therein, with the fastener device 34 mounted on the fastening limb 30.1, and with the shank 52 and nut 56 located in appropriate position on the fastener device 34. In addition, the module 10.1 will include a removable guide sleeve 60 which is positioned over the nut 56 and engages therewith. The sleeve 60 serves as a guide, as a conductor for the welding operation, and as a torque device.

For attaching the module 10.1 to the surface 36, an internal welding tool 62 will be employed. The tool 62 is electrically operated, and has a barrel which is shaped to engage with the sleeve 60 to provide a firm engagement therewith.

For attaching the module 10.1 to the surface, the module will be positioned against the surface in a desired position whereafter the barrel of the tool 62 will be inserted into the guide sleeve 60 and engaged therewith.

In this position the tool 62 can be actuated to cause an electrical current to flow through the sleeve 60, the shank 52 and the stud tip 54 into the casing 38. The tip 54, because of its relatively smaller cross-sectional area, burns away and thus starts and arc. The arc will be protected by the arc shield 58.

The shank 52 will not itself first be caused to move towards the surface 36 because it is held in position by the retainer flange (not shown) as discussed above.

As the welding operation continues, the intense heat of the arc will burn away the radial fingers of the retainer flange, thereby allowing the shank 52 to plunge into the molten metal formed by the arc. At this point the weld is completed with the shank 52 integrally mounted on the surface 36.

The nut 56 may now be tightened on the shank 52 simply by rotating the tool 62 about the axis of its barrel since the barrel is engaged with the sleeve 60, which is in turn engaged with the nut 56. The nut 56 can be tightened on the shank 52 until it bears against the fastener device 34 and displaces the fastener device 34 towards or into contact with the surface 36. During such displacement, the nut 56 operates as a bias means to bias the fastening limb 30.1 resiliently out of the mat 12 towards the surface 36. The unbiased position of the fastening limb 30.1 is shown in dotted lines in FIG. 2 whereas it is shown in solid lines in its resiliently biased position.

During resilient displacement of the limb 30.1, the yoke means 24.1 will apply tension to the anchor tube 26. Since the anchor tube 26 is an elongated rigid tube, the tension so applied will be distributed along the length of the tube 26. The tube 26 will therefore exert a resilient compression on the fiber between it and the surface 36 to thereby resiliently compress the fiber and thus the mat 12 into conforming engagement with the surface 36.

Since the limb 30.1 is resiliently displaced, the resilient compression of the material of the mat 12 into conforming engagement with the surface 36, will be maintained during the useful life of the module 10.1.

Because the fastening limb 30.1 is positioned proximate the cold face 16 of the module 10.1, the limb 30.1 and the adjacent portion of the connection limb 28.1 will be maintained at a sufficiently low temperature by the insulation material of the mat 12 for the yoke means 24.1 to maintain its resilience during use.

Resilient biasing of the mat 12 into conforming engagement with the surface 36 provides the advantage that the tendency for an air gap to be left or to be provided at the interface of the cold face 16 and the surface 36 will be reduced if not totally eliminated. Because the yoke means 24.1 maintains a resilient biasing effect, the cold face 16 should remain or should substantially remain in resilient engagement with the surface 36 even if the surface 36 becomes curved or bowed during deflection under the influence of temperature variations.

Applicant believes, therefore, that the elimination or reduction of any air gap between the cold face 16 and the surface 36 will reduce or totally eliminate any airflow downwardly along the surface 36 in this gap during use. Applicant believes, therefore, that this will eliminate or substantially reduce any heat loss and thus loss of efficiency attributable to such gas flow.

By limiting the movement of air along the interface between the cold face 16 and the surface 36, applicant believes that corrosion will further be inhibited.

The module 10.1 provides the further advantage that the attachment means 14.1 is provided largely in the interior of the module with only the fastening limb 30.1 and the fastener device 34 in the vicinity of the cold face 16. These will therefore be the only components which would, under average furnace conditions, be subjected to corrosion. The remaining parts of the yoke means 24.1 would tend to be spaced sufficiently from the cold face 16 to be at a sufficiently high temperature where water cannot exist and where sulfuric and sulfurous acids cannot therefore form.

If corrosion occurs in this low temperature zone through the formation of iron sulfates in the presence of the metal of the casing 38 and the yoke means 24.1, this will tend to result in corrosion of the cold face 16 of the mat 12. Such corrosion should, however, have no significant lasting harmful effect on the operation or efficiency of the module 10.1. Corroded ceramic fiber should remain in place and should provide substantially the same insulation effect as the non-corroded fiber. This is in distinct contrast with the prior art modules which employ cements or adhesives in this interface zone. In such prior art modules, corrosion of the fiber in this zone will result in the fiber being separated from the adhesive and will thus result in failure.

In contrast with the prior art, corrosion of the module 10.1 at the cold face 16 interface should have no significant effect on the insulation properties of the module 10.1 or on the attachment of the module 10.1 to the surface 36.

This is enhanced by the fact that the anchor tube 26 is non-corrosive, and that the yoke means 24.1 is made of a corrosion resistant material. In this regard it will be appreciated that the yoke means 24.1 may be additionally coated with a corrosion resistant material, if required.

The module 10.1 provides the further advantage that it has four soft sides which are not interfered with by a backing sheet, block, or the like.

Corresponding modules 10.1 can therefore be fastened to the surface 36 with their sides resiliently compressed into engagement with each other. This provides the advantage that if the casing 38 buckles towards the interior of the furnace into a convex shape as a result of temperature variation, if any gaps do form between adjacent modules 10.1 they would tend to be rather narrow and would tend to be shallow.

The module 10.1 provides the further advantage that if it is used for lining a ceiling of a furnace or the like, the anchor tube 26 distributes the location tension through the module 10.1 thereby reducing the tendency for the module 10.1 to sag away from the ceiling surface under the action of gravity. This should therefore again reduce the tendency for significant gaps to form between adjacent modules.

It will be noted from FIG. 1 of the drawings that the anchor tube 26 extends transversely to the fiber planes 20 thereby providing for effective location thereof in the mat 12.

It will further be noted that the yoke means 24.1 lies generally parallel to the fiber planes 20.

The attachment means 14.1 may therefore be located in position by taking say half of the fiber planes 20 of the module 10.1, locating the yoke means 24.1 in position thereon, inserting half of the anchor tube 26 into the fibers through the hook formation 32, and then threading the remaining half of the fiber planes 20 onto the remainder of the anchor tube 26. It will be appreciated that bores may be formed or drilled into the fiber planes 20 of the mat 12 for accommodating the tube 26.

Figure 3:
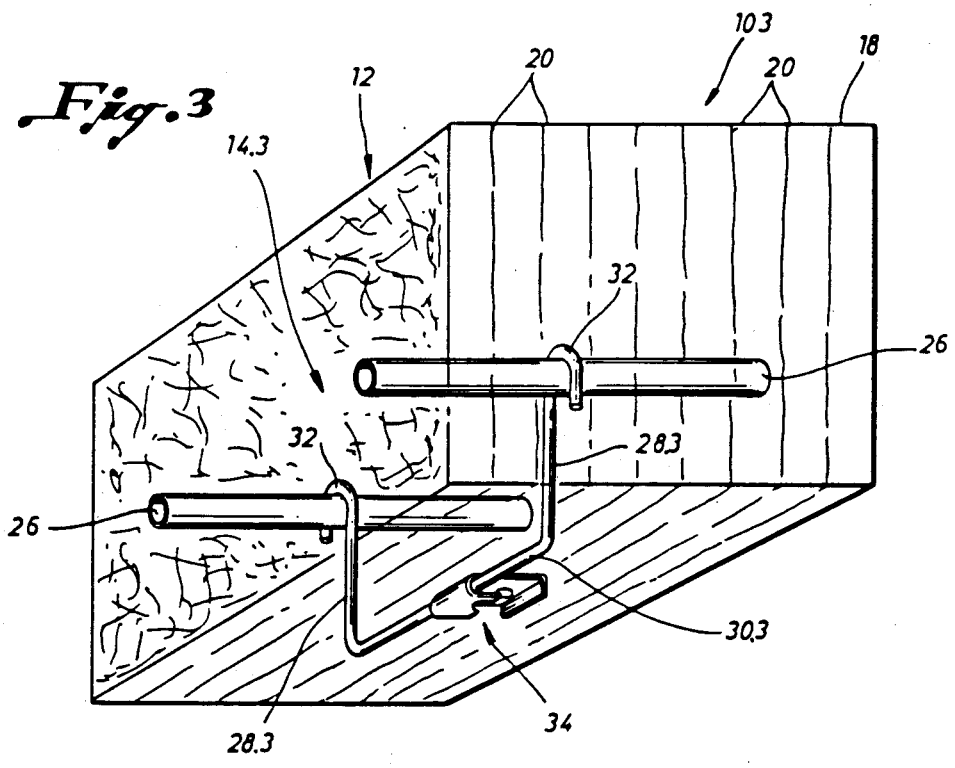
FIG. 3 shows a diagrammatic, oblique view of an alternative embodiment of a module in accordance with this invention.

With reference to FIG. 3 of the drawings, reference numeral 10.3 refers generally to an alternative form of module in accordance with this invention. The module 10.3 however corresponds substantially with the module 10.1. Like parts are therefore indicated by like reference numerals.

The module 10.1 is in the form of what would be termed a half module. It is therefore rectangular in plan view and is relatively narrow. It is primarily used for fitting into spaces which are too narrow for receiving regular modules. Because the module 10.1 is relatively narrow, a single anchor tube 26 may be employed with a single connection limb 28.1 and fastener 30.1 for the yoke means 24.1.

The module 10.3 illustrated in FIG. 3 is more a module of regular size which would be square or rectangular in plan view. Because the module 10.3 is relatively wider than the module 10.1, the attachment means 14.3 has been expanded to distribute the resilient tension applied to the mat 12 of the module 10.3 more effectively through the module 10.3.

The module 10.3 would typically be 12 inches by 12 inches in size. In preferred application thereof, it would be mounted with corresponding modules in 11 inch by 11 inch spaces to provide for particularly effective resilient compression of the modules.

The attachment means 14.3 comprises a pair of ceramic anchor tubes 26 which are provided parallel to each other in laterally spaced relationship. The tubes 26 again extend transversely to the fiber plans 20 for effective and firm embedment in the mat 12.

The yoke means 24.1 comprises a pair of connection limbs 28.3. Each connection limb 28.3 has a hook formation 32 at its free end which is hooked around one of the tubes 26.

The opposed ends of the connection limbs 28.3 are interconnected by means of an integral fastening limb 30.3. The fastening limb 30.3 has the fastener device 34 located thereon.

The fastening limb 30.3 is recessed about ½ inch inwardly of the cold face 16, is parallel to the cold face 16, and is resiliently bendable or deflectable towards the cold face 16 for attachment to a casing or furnace wall surface to thereby resiliently bias the anchor tubes 26 and thus the mat 12 into conforming engagement with the surface.

With reference to FIGS. 4 to 7 of the drawings, reference numeral 10.4 refers generally to a high temperature furnace insulation module which corresponds substantially with the module 10.3. Corresponding parts are therefore indicated by corresponding reference numerals.

Figure 4:
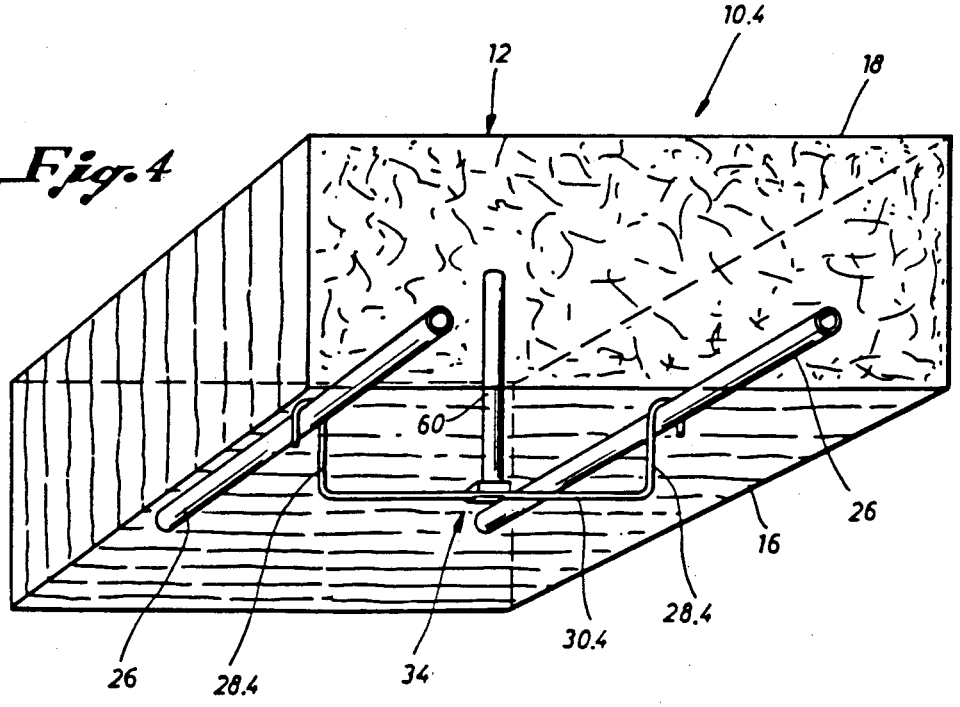
FIG. 4 shows a similar view of a module similar to that of FIG. 3, except that a fastener member is shown in position in the module.

In FIG. 4 of the drawings the module 10.4 is shown prior to attachment to a surface of a furnace casing. The fastener device 34 is shown having a guide sleeve 60 positioned thereon for guiding an internal welding tool 62 into position as described with reference to FIG. 2.

Figure 5:
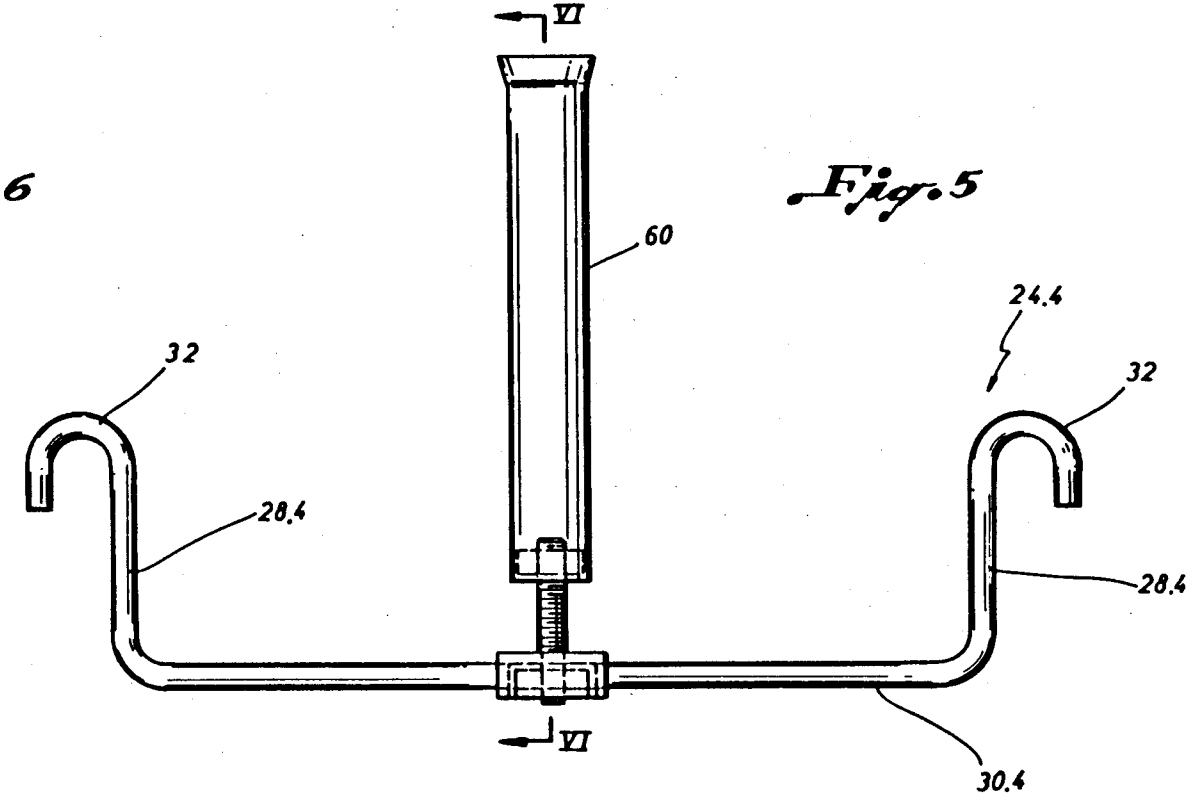
FIGS. 5 and 6 show, to an enlarged scale, a side elevation and a section along the line VI—VI of FIG. 5 of the yoke means of the attachment means of the module of FIG. 4.
Figure 6:
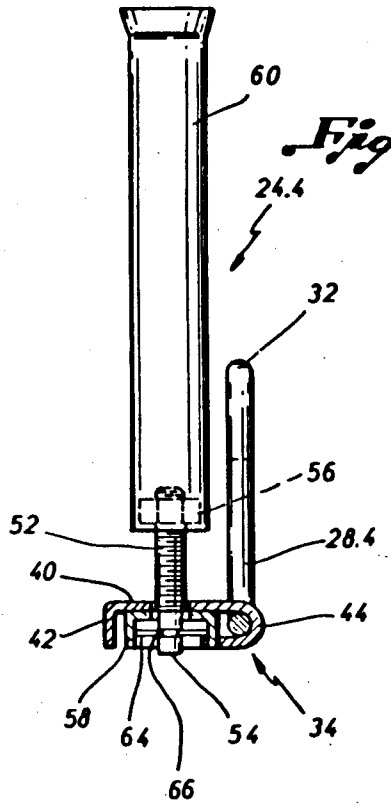

The attachment means 14.4 of the module 10.4 is illustrated in detail in FIGS. 5 and 6 of the drawings. Corresponding parts have been identified with corresponding reference numerals to those shown in FIG. 2. However, a retainer flange 64 has been shown in position in FIG. 6. These retainer flange 64 has its outer periphery cooperating with the arc shield 58 to retain the arc shield in position. The retainer flange 64 has radially inwardly extending fingers which extend into an annular groove 66 provided about the stud tip 54. When these fingers melt during the welding operation they release the shank 52 thereby permitted the remaining part of the tip 54 to be welded onto the surface 36.

In FIG. 7 of the drawings the module 10.4 is shown fixed to the surface 36. The fastener device 34 has been displaced into contact with the surface 36 by tightening the bias means in the form of the nut 56 on the shank 52. This has resulted in resilient deflection of the fastening limb 30.4 from its original position as shown in solid lines in FIG. 7 to its final resiliently deflected position as shown in dotted lines in FIG. 7. This resilient deflection of the fastening limb 30.4 causes a resilient bias tension on the anchor tubes 26. This is distributed by the rigid anchor tubes 26 through the length of the mat 12 for the fiber material of the mat 12 to be biased into conforming engagement with the surface 36.

With an appropriate degree of resilient compression, the fiber material of the mat 12 will be firmly engaged with and will remain in engagement with the surface 36 regardless of its particular surface configurations during use.

Figure 8:
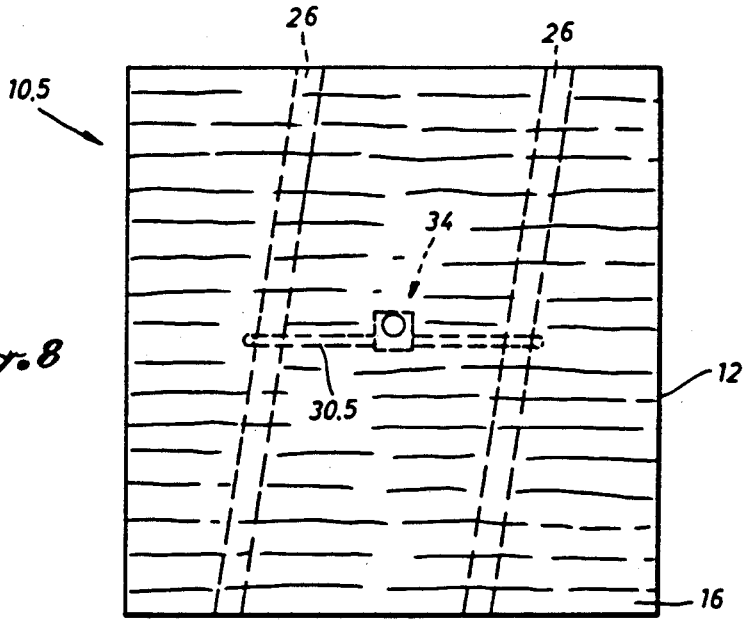
FIG. 8 shows a diagrammatic plan view of an alternative embodiment of a module in accordance with this invention.

With reference to FIG. 8, reference numeral 10.5 refers generally to yet a further alternative embodiment of a module in accordance with this invention. The module 10.5 corresponds substantially with the module 10.4 except that the anchor tubes 26 are arranged parallel to each other at an acute angle to the one pair of opposed sides of the mat 12.

This arrangement of the tubes 26 provides the advantage that two corresponding modules 10.5 can be mounted soldier fashion next to each other in resiliently compressed side-by-side engagement without interference between the anchor tubes 26 of the two adjacent modules 10.5. This is achieved by the inclined tubes 26 since they will not be in line.

Figure 9:
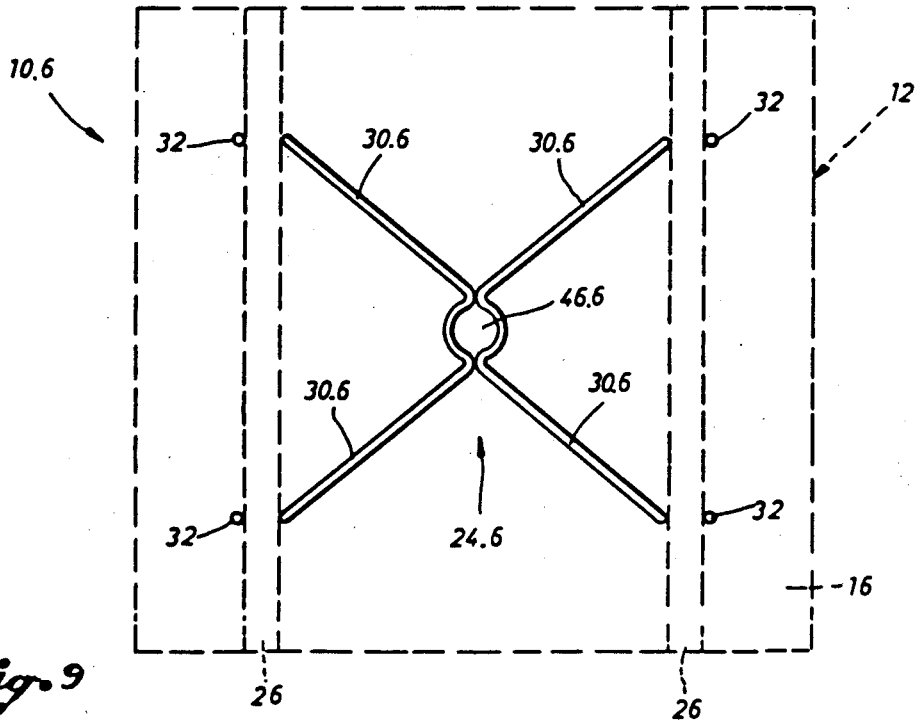
FIG. 9 shows an underside, diagrammatic plan view of yet a further alternative embodiment of a module in accordance with this invention.

With reference to FIG. 9, reference numeral 10.6 refers to yet a further alternative embodiment of a module in accordance with the invention.

In the module 10.6, the yoke means 24.6 comprises two corresponding yoke members which have been resistance welded to each other to define a bore 46.6 for receiving the stud tip 54 and threaded shank 52 of a fastener member 48.

The module 10.6 provides the advantage that the resilient tension applied by the yoke means 24.6 will be distributed further throughout the major plane of the mat 12 by the four connecting limbs to thereby encourage resilient biasing of the mat 12 into conforming engagement with a surface on which it is mounted.

With reference to FIGS. 10 and 11 of the drawings, reference numeral 24.7 refers generally to an alternative embodiment of yoke means to the yoke means 24.1 illustrated in FIG. 1.

The yoke means 24.7 is formed by bending an elongated high yield metal rod into an L-shape to define connection limbs 28.7 and fastening limbs 30.7.

The connection limbs 28.7 define a hook formation which is hooked onto the anchor tube 26, while the fastening limbs 30.7 define a bore 46.7 over which a washer can be positioned to distribute the load applied by a fastening stud, bolt or screw when used to resiliently bias the fastening limbs 30.7 into engagement with a furnace wall or casing surface.

With reference to FIG. 12 of the drawings, reference numeral 10.8 refers generally to yet a further alternative embodiment of a module in accordance with this invention.

The module 10.8 corresponds generally with the module 10.4 except that the module 10.8 has attachment means comprising three anchor tubes 26, three connection limbs 28.8 and a single fastening limb 30.8 which is connected to the three connection limbs 28.8.

By increasing the number of anchor tubes 26 and the number of connection limbs 28.8, the resilient tension applied to the mat 12 can be increased as required for various sizes of modules and various applications of the invention.

In FIG. 12 the mat 12 of the module 10.8 has been strengthened to improve its durability.

The mat has been strengthened by depositing, such as by injection, a suitable resin in the zones 75 between the anchor tubes 26 and the cold face 16.

The resin in the zones 75 sets to provide reinforced zones 75 which resist elongation of the holes in which the anchor tubes 26 are provided. Thus when the tubes 26 are resiliently biased towards a furnace wall surface, the tubes will effectively compress the insulation material into engagement with the surface.

The reinforced zones 75 therefore assist in distributing the compression forces of the tubes 26.

Any suitable resin or weak cement such as, for example, a colloidal silica may be provided in the zones 75.

It will readily be appreciated that the compression force of the tubes 26 may also be distributed by other means such as, for example, by means of lateral extensions from the tubes if desired.

For ease of handling of modules in accordance with this invention, they may be wrapped in gauze material or paper, or may be bound with strips of paper, elastic material or the like. The wrapping or binding material is preferably a material which will rupture on firing to release the mats 12 and allow the fibers of the mats to expand resiliently.

I claim:

1. An insulation member for use in insulating a furnace surface, the insulation member comprising:

a mat of insulation material, the insulation material being resilient and compressible, the mat having a resilient deformable cold face adapted to engage a furnace surface so that air gaps are minimized when the resilient deformable cold face is compressed against the furnace surface;

attachment means positioned in the mat for attaching the mat to the furnace surface, the attachment means being adapted to be fastened to the furnace surface, the attachment means being operative to generate a distributed bias force through the mat to compress substantially the entire cold face surface against the furnace surface.

2. The insulation member according to claim 1, wherein:

the attachment means includes a rigid member extending through the mat of insulation material, the rigid member being displaceable toward the cold face of the mat, the rigid member being operative to generate a distributed bias force through the mat when the rigid member is displaced towards the cold face of the mat.

3. The insulation member according to claim 2, wherein:

the attachment means includes a bias means for displacing the rigid member toward the cold face of the mat.

4. The insulation member according to claim 3, wherein:

the attachment means includes fastening means for fastening the mat to the furnace surface.

5. The insulation member according to claim 4, wherein:

the fastening means includes a shank adapted to be stud welded to the furnace surface.

6. The insulation member according to claim 5, wherein:

the bias means includes a nut adapted to threadably engage the shank, the nut being operative to create a bias force when the nut is tightened by screwing it down the shank after the shank has been welded to the furnace surface.

7. The insulation member according to claim 2, wherein:

the mat has a hot face opposite from the cold face; and, the rigid member is recessed inside the insulation material and is spaced from the hot face of the mat.

8. The insulation member according to claim 7, wherein:

the rigid member extends from one side of the mat to the opposed side of the mat.

9. The insulation member according to claim 8, wherein:

the rigid member is spaced from the cold face of the module having resilient and compressible insulation material disposed between the rigid member and the furnace surface.

10. The insulation member according to claim 9, wherein:

the rigid member comprises a rigid tube.

11. The insulation module according to claim 10, wherein:

the attachment means comprises a yoke means including a connection limb and a resiliently deformable fastening limb, the connection limb being operative to engage the rigid member, the fastening limb being operative to engage the shank, the connection limb being deformable when the nut is tightened by screwing it down the shank, the connection limb being operable to urge the rigid member toward the cold face when the nut is tightened.

12. The insulation member according to claim 11, wherein:

the insulation material comprises ceramic fiber insulation.

13. The insulation member according to claim 12, wherein:

the ceramic fiber insulation material has fibers randomly oriented in fiber planes, the fiber planes being arranged in side-by-side relationship to extend from the cold face to the hot face generally perpendicular thereto.

14. An insulation member for insulating a furnace, the insulation member comprising:

(a) an insulation mat of resiliently deformable insulation material, the mat having a resiliently deformable cold face to be positioned against a furnace surface, the mat having an opposed hot face;

(b) attachment means for attaching the mat to such a furnace surface;

(c) the attachment means comprising anchor means which is positioned in the mat in spaced relationship with both the cold face and the hot face to locate the attachment means relatively to the mat, and connection means for attachment to such a furnace surface to attach the member to such a surface;

(d) the connection means being connected to the anchor means to be displaceable relatively thereto, and being recessed inwardly relative to the cold face, the attachment means being operative to compress the cold face of the mat against such a furnace surface when force is applied to the connection means to urge it towards such a furnace surface for attachment thereto; and, (e) the anchor means comprising a plurality of elongated anchor members which are positioned to extend through the mat for distributing force applied to the connection means through the mat for compressing the mat cold face into firm engagement with the furnace surface, the resiliently deformable cold face being adapted to minimize air gaps between the mat and the furnace surface.

15. A member according to claim 14, in which the insulation material comprises a fibrous insulation material including fiber planes which are arranged to extend transversely to the cold face of the member, with the fibers of the insulation material being randomly oriented in the fiber planes.

16. A member according to claim 15, in which the attachment means is resiliently deformable for resiliently biasing or urging the mat into contact with a surface to be insulated when the attachment means is attached to such a surface.

17. A member according to claim 15, in which the connection means comprises a yoke having at least one connecting limb which is connected to the anchor means and extends towards the cold face, and having a fastening limb for attachment to a surface to be insulated.

18. A member according to claim 17, in which the yoke is resiliently deformable by the fastening limb, the yoke being resiliently flexible for a portion thereof to be resiliently deflectable towards a surface to be insulated for attachment to such a surface, the yoke thus being operative to resiliently bias the mat towards such a surface.

19. A member according to claim 18, in which the fastening limb extends transversely to the connecting limb, and in which the fastening limb is positioned proximate to the cold face where the material of the mat protects the resiliently flexible portion from losing its resiliency during use under temperature conditions for which the member is designed.

20. A member according to claim 17, in which the yoke has a pair of connecting limbs which are connected together by means of the fastening limb to provide a channel section configuration for the yoke, and in which the free end portion of each of the connecting limbs is connected to one of the anchor members.

21. A member according to claim 20, in which the anchor means comprises a plurality of elongated anchor tubes which are located in the mat in laterally spaced relationship, and in which each has one connecting limb connected thereto.

22. A member according to claim 14, in which the connection means includes a fastener device to be attached to a surface to be insulated to attach the connection means to such a surface, the fastener device defining a fastener zone.

23. A member according to claim 14, in which the elongated anchor members are positioned to extend through the mat for distributing force applied to the connection means through the mat for resiliently compressing the mat cold face into substantially complete conforming engagement with the furnace surface when the connection means is urged towards such furnace surface upon attachment thereto.

24. A member according to claim 14, in which the connection means is removably connected to the anchor means.

25. A member according to claim 22, in which the connection means comprising a yoke having a pair of connecting limbs which are connected together by means of a fastening limb to provide a generally channel section configuration for the yoke, in which the free end portions of the connecting limbs are connected to the anchor members, and in which the fastener device is fixed to the fastening limb.

26. A member according to claim 25, including a fastener member located on the fastener device, the fastener member being adapted to be secured to a surface to be insulated, and the fastener member including bias means for urging the fastener member and thus urging the attachment means towards such a surface to resiliently urge or compress the mat into firm engagement with such a surface.

27. A member according to claim 14, in which the attachment means is embedded within the mat.

28. A member according to claim 20, in which the yoke is flattened at the junction zone of each connecting limb with the fastening limb to reduce bending resistance in the junction zone to allow bending of the connecting limbs toward and away from each other.

29. A member according to claim 25, in which the fastener member comprises a weld stud to be fastener to such a surface by means of an internal welding operation, the weld stud being threaded and including bias means in the form of a nut for biasing the attachment means towards such a surface.

30. A member according to claim 29, in which the fastener device comprises a fastener bracket which is fixed to the connection means, the fastener bracket having a bore through which a fusible portion of the weld stud extends, and having an arc shield which surrounds the fusible portion.

31. A member according to claim 22, in which the connection means is embedded within the mat, and in which the fastener device defines the fastener zone in a position proximate to the cold face and positioned centrally relative to the periphery of the cold face.

32. A member according to claim 14, which is in the form of an insulation module for attachment in side-by-side relationship with corresponding modules to wall surfaces of a furnace for insulating such walls, and in which the insulation material comprises a ceramic fiber insulation material.

33. A member according to claim 14, in which the connection means includes a fastener zone for use in attaching the connection means to a furnace surface to be insulated, and in which the fastener zone is recessed relatively to the cold face of the mat but is positioned nearer to the cold face than the anchor means.

34. A member according to claim 15, in which the anchor means is arranged to extend transversely to the fiber planes.

35. An insulation module for insulating a furnace surface, the insulation module comprising:

(a) an insulation mat of resiliently deformable insulation material, the mat having a resiliently deformable cold face to be positioned against a furnace surface, the mat having an opposed hot face;

(b) attachment means for attaching the mat to such a furnace surface;

(c) the attachment means comprising anchor means which is positioned in the mat in spaced relationship with both the cold face and the hot face to locate the attachment means relatively to the mat, and connection means for attachment to such a furnace surface to attach the module to such a surface;

(d) the connection means being connected to the anchor means and being recessed inwardly relative to the cold face for the attachment means to compress the cold face of the mat against such a surface when force is applied to the connection means to urge it towards such a furnace surface for attachment thereto; and, (e) the anchor means comprising a plurality of elongated anchor members which are positioned to extend through the mat for distributing force applied to the connection means through the mat for compressing the mat cold face substantially into complete resilient engagement with the furnace surface, the resiliently deformable cold face being adapted to conformingly engage a nonplanar furnace surface to minimize air gaps between the cold face and the furnace surface.

36. An insulation module according to claim 35, in which the anchor means is designed to distribute force applied to the connection means through the mat to bias the cold face of the mat into conforming resilient engagement with the furnace surface to be insulated when the connection means is urged towards and attached to such a furnace surface.

37. An insulation member for insulating a furnace surface, the insulation member comprising:

(a) an insulation mat of resiliently deformable insulation material having a cold face to be positioned against such a furnace surface, and having an opposed hot face; and (b) attachment means for attaching the mat to such a furnace surface;

(c) the attachment means comprising anchor means which is positioned in the mat in spaced relationship with both the cold face and the hot face to locate the attachment means relative to the mat, and connection means for attachment to such a furnace surface to attach the member to such a surface;

(d) the connection means being connected to the anchor means and being recessed inwardly relative to the cold face, the attachment means being operative to compress the cold face of the mat against such a furnace surface when force is applied to the connection means to urge it towards such a furnace surface for attachment thereto;

(e) the anchor means being positioned to extend through the mat for distributing force applied to the connection means through the mat for compressing substantially the entire mat cold face into engagement with the furnace surface to prevent the formulation of gaps between the cold face of the mat and such a furnace surface during use.

38. A method of providing insulation on a furnace surface, the method comprising the steps of:

attaching a mat of a resiliently compressible insulation material, which has a cold face to be positioned against such a furnace surface and which has an opposed hot face, to such a surface by means of attachment means which is spaced from both the cold face and the hot face; and, applying force to the attachment means to displace the attachment means towards the surface and urge the cold face of the mat into engagement with the surface, the attachment means including anchor means which extends through the mat to distribute the applied force through the mat to cause resilient compression of the cold face of the mat against the furnace surface.

39. A method according to claim 38, further comprising the step of biasing the cold face of the mat into conforming engagement with the furnace surface.

40. A method according to claim 38, further comprising the step of resiliently displacing the attachment means towards the furnace surface to resiliently bias the cold face of the mat into engagement with the furnace surface.

41. A method according to claim 38, further comprising the step of compressing the cold face of the mat against the furnace surface to minimize gaps between the cold face and furnace surface.

42. A method according to claim 38, wherein the resilient compression of the cold face is sufficient to prevent gaps forming between the cold face and the furnace surface during use.

43. A method according to claim 38, further comprising the step of embedding the attachment means within the mat prior to attachment of the mat to the furnace surface.

* * * * *

UNITED STATES PATENT AND TRADEMARK OFFICE

CERTIFICATE OF CORRECTION

PATENT NO. : 4,984,405

DATED : January 15, 1991

INVENTOR(S) : Robert A. Sauder

It is certified that error appears in the above—identified patent and that said Letters Patent is hereby corrected as shown below:

Column 19, line 15 (claim 29, line 2), "fastener" (second occurrence) should be -- fastened --.

Column 20, line 45 (claim 37, line 6 of (e)), "formulation" should be -- formation --.

Signed and Sealed this

Twelfth Day of May, 1992

*Attest:*

DOUGLAS B. COMER

*Attesting Officer*

*Acting Commissioner of Patents and Trademarks*